US007637505B1

(12) United States Patent
Foster

(10) Patent No.: US 7,637,505 B1
(45) Date of Patent: Dec. 29, 2009

(54) INCLINED SURFACE FEATURE FOR GAME ASSEMBLY

(75) Inventor: Bruce Foster, East Longmeadow, MA (US)

(73) Assignee: Hasbro, Inc., Pawtucket, RI (US)

( * ) Notice: Subject to any disclaimer, the term of this patent is extended or adjusted under 35 U.S.C. 154(b) by 75 days.

(21) Appl. No.: 11/443,642

(22) Filed: May 31, 2006

(51) Int. Cl.
*A63F 3/00* (2006.01)

(52) U.S. Cl. ..... 273/287; 273/285

(58) Field of Classification Search ..... 273/285, 273/287, 241; D21/324–335; 312/243, 244; 190/16
See application file for complete search history.

(56) References Cited

U.S. PATENT DOCUMENTS

| | | | | | |
|---|---|---|---|---|---|
| 2,053,598 | A | | 5/1936 | Blau | |
| 2,707,538 | A | * | 5/1955 | Mayer, Sr. et al. | 190/16 |
| 2,935,165 | A | * | 5/1960 | Elliott | 190/16 |
| 3,124,225 | A | * | 3/1964 | Rosenberg | 190/16 |
| 3,540,576 | A | * | 11/1970 | Looney et al. | 206/303 |
| 4,005,537 | A | * | 2/1977 | von Camber et al. | 40/610 |
| 4,136,871 | A | | 1/1979 | Meyers et al. | |
| 4,194,628 | A | * | 3/1980 | Campos | 206/570 |
| 4,194,742 | A | * | 3/1980 | Adams | 273/265 |
| 4,415,161 | A | | 11/1983 | Westell | |
| 4,513,974 | A | * | 4/1985 | Lin | 273/239 |
| D280,511 | S | * | 9/1985 | Moggridge et al. | D14/315 |
| 4,796,369 | A | * | 1/1989 | Hamann | 40/606.15 |
| 4,801,148 | A | | 1/1989 | Lamb | |
| 4,839,837 | A | * | 6/1989 | Chang | 361/680 |
| D317,380 | S | * | 6/1991 | Snyder | D3/295 |
| D375,126 | S | * | 10/1996 | Ikenaga | D21/330 |
| 5,729,215 | A | * | 3/1998 | Jutras | 340/908.1 |
| 5,979,620 | A | * | 11/1999 | Lurie et al. | 190/16 |
| 6,643,124 | B1 | * | 11/2003 | Wilk | 361/681 |
| D499,772 | S | | 12/2004 | Creech | |
| D500,095 | S | | 12/2004 | Creech | |
| D546,398 | S | * | 7/2007 | Foster | D21/330 |
| 2003/0222397 | A1 | * | 12/2003 | Guyer et al. | 273/146 |

OTHER PUBLICATIONS

Electronic Battleship(R) Advanced Mission Game, Hasbro, Inc. Copyright 2001.

* cited by examiner

*Primary Examiner*—Vishu K. Mendiratta
(74) *Attorney, Agent, or Firm*—Perry Hoffman

(57) ABSTRACT

A game device that uses an inclined playing surface to achieve the goal of making the game more convenient by allowing the player easier accessibility to game pieces. The game assembly includes a base, an upright module and a pair of support assemblies. The inclined playing surface is achieved through combination of a locking hinge and an interlocking set of bars. The locking hinge is achieved through the connection of a set of plastic fasteners on the pair of support assemblies to a set of notches on the base. The locking hinge allows the support assemblies to be able to pivot upwards towards the upright assembly. The interlocking set of bars is achieved through the even spacing of bars along the bottom edge of the base and the edge of the pair of support assemblies. An ergonomic design is achieved for player use of the game device with the base and upright assembly supported at the base, with the two gaming surface assemblies connected to the base such that when the device is on a supporting surface, the game surface assemblies extend angularly upwardly from the supporting surface to the base. The base may also include player interface electronic control panels.

8 Claims, 3 Drawing Sheets

INCLINED SURFACE FEATURE FOR GAME ASSEMBLY

BACKGROUND OF THE INVENTION

1. Field of the Invention

The present invention relates to a game assembly, and more particularly to a portable board game device that unfolds to create an inclined playing surface.

2. Description of the Related Art

The design of board game devices has long been known. Board game devices are designed with the consumer in mind.

Board game devices have long used different methods to alter the playing surface to give it more appeal to the consumer. One such way was disclosed in the U.S. Pat. No. 4,136,871 to Meyers et al. for "Rotary table ball game" issued Jan. 30, 1979. Meyers generally relates to a high speed rotary game table having nets placed at opposite ends of a playing surface that provides goals at each end with player operated flippers located at various points. The Meyers playing surface is separated into two distinct halves which are connected together in the center by a hinge on the opposite end of the playing surface as to not disturb the game in progress. The halves are hinged so that the game board will fold down the center in order to make the game easier to transport. The gaming surface is inclined so that the highest point occurs at the intersection of the two halves and the lowest point occurs where the goals are placed. The playing surface is intended to be inclined so that the game ball is never at rest. This is particularly important when first dropping the ball in the center of the playing surface so that game play may quickly begin. The inclined surface also serves a benefit of the game ball accelerating quicker as it moves toward the goal because the slope is angled toward the goals. This serves the primary benefit of increasing the overall experience of the game by challenging the players reaction skills thought the rapid motion of the game ball.

Whereas the benefit of the inclined playing surface of the Meyer's patent is to the overall experience of the game play, it was not designed to make the game more convenient to play by making the game board more accessible. It is not known in the art to provide a game device designed to allow the playing surface to incline to create a more accessible game board thus making the making the game more convenient to play. Accordingly it would be desirable to create such a device as it would be well received by the consumer. The inventions discussed in connection with the described embodiments address these and other deficiencies of the prior art.

SUMMARY OF THE INVENTION

The present invention relates to game assemblies that provide an inclined gaming surface for traditional board games and the like. The game assembly contains an upright assembly, a pair of support assemblies and a base. The base serves as an orient module to which the upright assemblies and the pair of support assemblies attach. The upright assembly is attached to the top of the base and the pair of support assembles are then attached to the sides of the base. The base also contains a player interface electronic control panel.

The pair of support assemblies and the base are designed so that when they are attached they create a locking hinge. The locking hinge allows the support assemblies to be able to pivot upwards towards the upright assembly. When folded in this direction, the pair of support assemblies may be folded up to the point where they meet the upright assembly. This results in game assembly being compacted for storage or to be more easily moved.

Additionally, the locking hinge allows the pair of support assemblies to fold downward or in the opposite direction of the upright assembly. When folded in this direction, the pair of support assemblies fold downward along the locking hinge. The pair of support assemblies may be folded to a set predetermined point where when set down the ends of the pair of support assemblies would support the weight of the game assembly and stand balanced. At this set predetermined point, the locking hinge locks so that the pair of support assemblies will not fold downward anymore. The base and the pair of support assemblies each contain a set of bars that interlock when the pair of support assemblies is folded downward to help support the locking hinge in stopping the pair of support assemblies from continuing to fold downward. This produces the pair of support assemblies lying at an incline and the base and upright assembly being suspended in the air. When folded in this position the game assembly may stand on its own creating the inclined gaming surface.

Briefly summarized, the present invention relates to a game device that uses an inclined playing surface to achieve the goal of making the game more convenient by allowing the player easier accessibility to game pieces.

Further advantages of the present invention, together with the organization and operation thereof, will become apparent from the following detailed description of the invention when taken in conjunction with the accompanying drawings wherein like elements have like numerals throughout the drawings.

BRIEF DESCRIPTION OF THE DRAWINGS

The inventions will now be more particularly described by way of example with reference to the accompanying drawings, the advantages of which may be best understood with reference to the following detailed description taken in conjunction with the drawing figures, in which.

Figure 1:
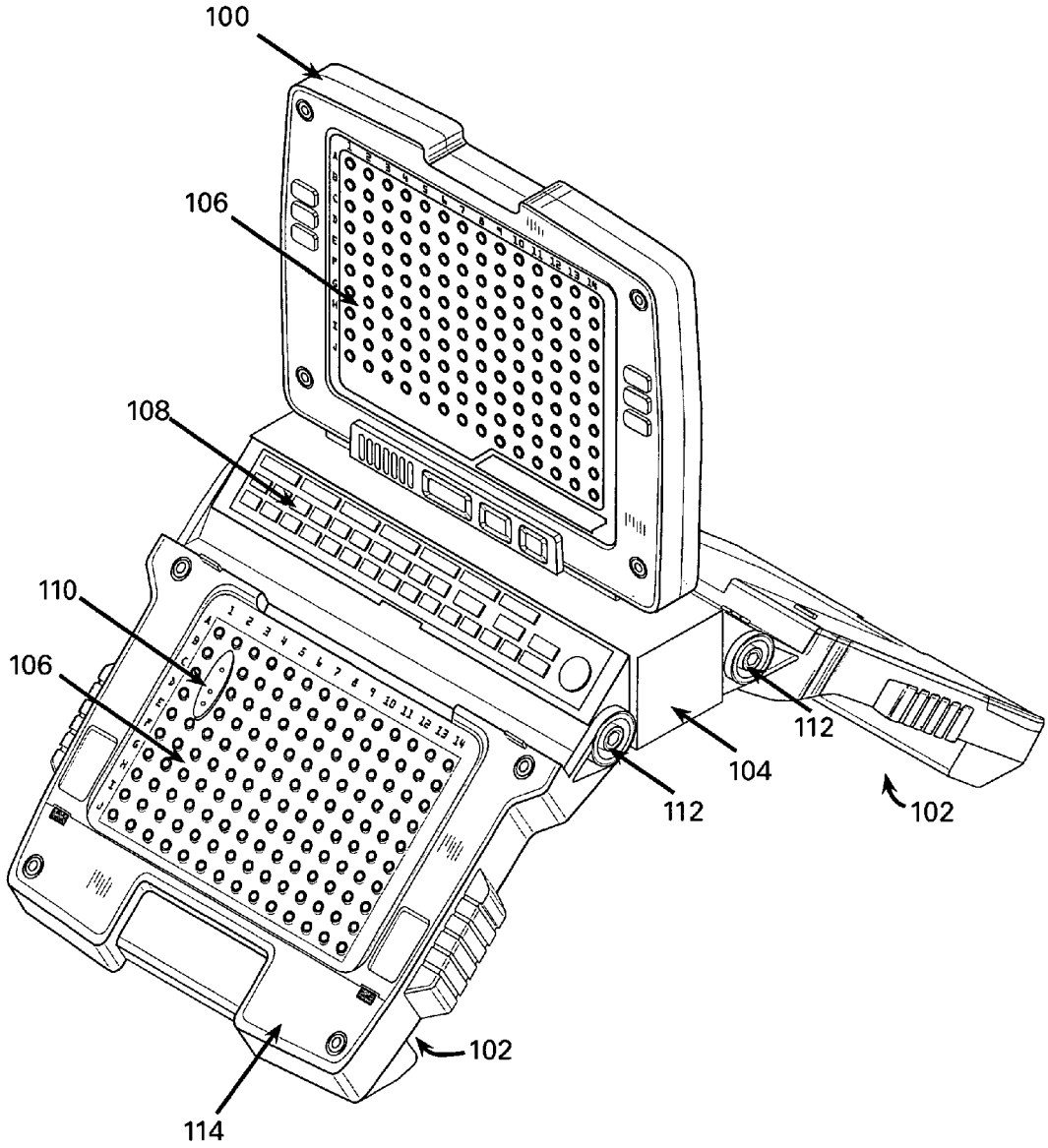
FIG. 1 is a view of the game assembly when the pair of support are folded downward and locked in place by the locking hinge in accordance with the present invention.

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

DETAILED DESCRIPTION OF THE PREFERRED EMBODIMENTS

A present preferred embodiment is implemented employing the classic board game of Battleship™ as described herein, the design of which is covered in applicant's assignee's co-pending U.S. Design patent application No. 29/260,706, now U.S. Design Pat. No. D546,398 issued Jul. 10, 2007 filed on even date, the entire disclosure of which is hereby incorporated herein by reference. The present described embodiment incorporates an inclined surface feature creating a game assembly that makes game play and game pieces more easily accessible to the players.

With reference to FIG. 1, the game assembly includes four main elements: an upright assembly 100, a pair of support assemblies 102, and a base 104. The upright assembly 100 fits securely onto the top of the base 104. Each of the pair of support assemblies 102 connects to opposite sides of the base 104. This connection is made by a locking hinge 112. The locking hinge 112 allows the pair of support assemblies to pivot around the base 104 but also lock into place at a predetermined angle.

Each of the pair of support assemblies 102 has at least a first gaming surface 106 that allows the placement of a set of game pieces 110. At each end of the pair of support assemblies 102 is a storage compartment 114. The storage compartment 114 is a hollow receptacle within each of the pair of support assemblies 102 and is accessed by removing a sliding cover. The storage compartment 114 is useful for storing the set of game pieces 110. Additionally, the upright assembly 100 has a second gaming surface 106 on both sides that allows the placement of a set of game pieces 110. The upright assembly 100 and the base 104 are thus elevated for supporting the upright assembly 100 connected to the top of the base 104 with the pair of support assemblies 102 connected to the sides of the base 104 for supporting the at least first gaming surface 106 at its inclined angle.

The gaming surfaces 106 and the set of games pieces 110 are designed to associate the game play of the underlying board game. In the preferred embodiment, the game assembly implements an advanced version of classic Battleship in which the game device uses the inclined playing surface to achieve the goal of making the game more convenient by allowing the player easier accessibility to game pieces. The inclined playing surface is achieved through the described combination of the locking hinge and interlocking set of bars or the like. As described, the interlocking set of bars are provided with even spacing of bars along the bottom edge of the base and the edge of the pair of support assemblies. Accordingly an ergonomic design is achieved for player use of the game device with the base and upright assembly supported at said base, and the two gaming surface assemblies connected to the base such that when the device is on a supporting surface, the game surface assemblies extend angularly upwardly from the supporting surface to the base. As described, at least one of the gaming surface assemblies support the base in its elevated orientation with the upright assembly supported at the base. As described further, the base may also include one or more player interface electronic control panels.

The classic Battleship game involves two players in a simulated naval battle. Each player deploys their fleet of five ships in a pattern on a fourteen by ten grid. The ships vary in length from two to five units, thus many combinations of fleet deployment are possible. Players then take turns calling a grid coordinate. If a player guesses a grid coordinate where one of their opponent's ships is located, the player has scored a hit. If a player guesses a grid coordinate where one of their opponent's ships is not located, the player has missed. Game play continues until one of the players has sunken their opponents entire fleet and is the winner.

In the advanced version of Battleship, the entire game is controlled electronically by a printed circuit (PC) board located in the base 104 of the game assembly. The use of the PC board allows the addition of additional dimensions to the simplistic game play. In the advanced version, players can now use advanced weapons such as tomahawk missiles and fighter jet attack squadrons. A player also has the ability to forego an attack during their turn to instead use sonar to help narrow down the location of their opponent's fleet.

For the game of Battleship, the set of games pieces 110 include of a group of different colored pegs and a set of miniature plastic replicas of naval ships on pegs. The colors of the pegs represent different outcomes of a turn; red signifies that player has called out a correct coordinate and has hit an opposing players ship, white signifies that the player has called out an incorrect coordinate and has not hit an opposing players ship, and blue signifies the presence of an opposing player's ship after a sonar is performed.

The gaming surface 106 is a fourteen by ten grid of holes big enough that the pegs from the set of game pieces 110 may fit easily but securely in them. The grid on the gaming surface 106 is numbered one through fourteen along the top and lettered "A" through "J" along the side. This allows the player to refer to a specific spot of the gaming surface 106 by the grid coordinate according to the number of the row and the letter of the column, e.g. J3.

As referred to above, the base 104 contains a PC board and information processor. The PC board is powered by AA batteries located in the base 104. The base 104 also serves as an orient module to which the upright assemblies and the pair of support assemblies attach, as described further below. The base 104 further contains player interface electronic control panels 108, thus facilitating a user-interface for the game assembly using the information processor provided in the base 104. To activate the information processor, whether to start a game or to control game play, the base 104 has a player interface electronic control panel 108. The player interface electronic control panel 108 includes, e.g., a keypad which refers to, among other things, grid coordinates, different choices of advanced weaponry, and commands to fire. The player interface electronic control panel 108 inputs a player's commands, which in turn get processed via the user-interface for the game. The PC board then determines the outcome of the player's selection and emanates the appropriate output sound or visual through a speaker or colored LED's. The speaker is located on the bottom panel of the base 104. The colored LED's are located on the top panel of the base 104.

Figure 2:
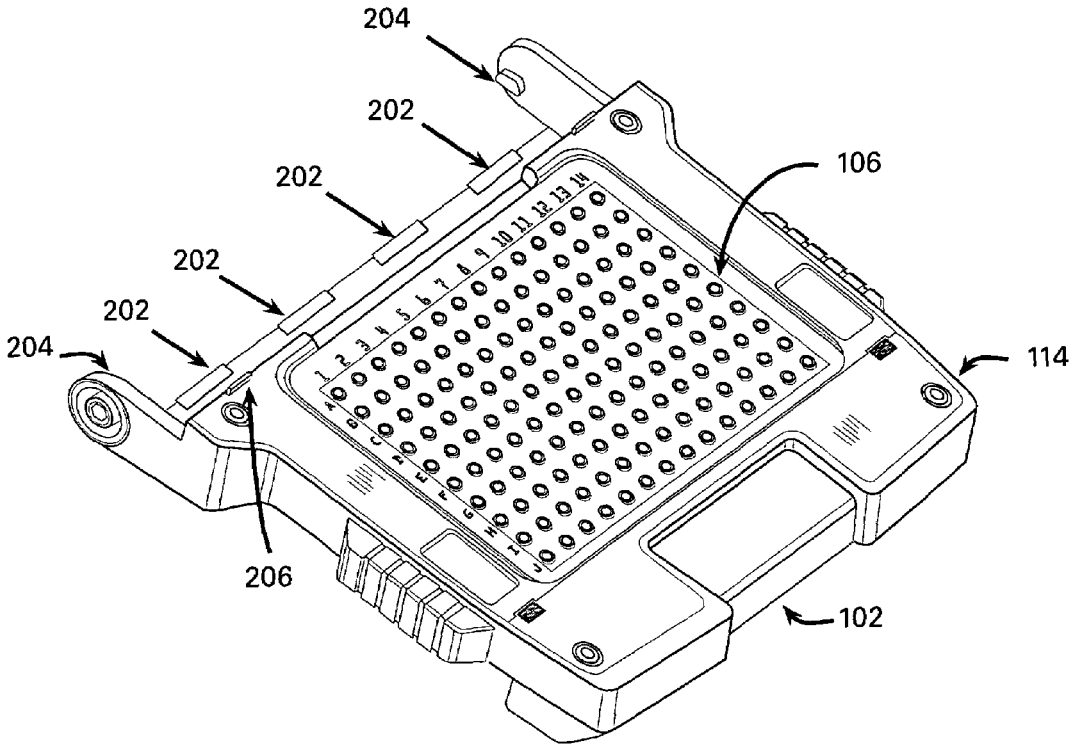
FIG. 2 shows an isolated view of one of the pair of support assemblies.
Figure 3:
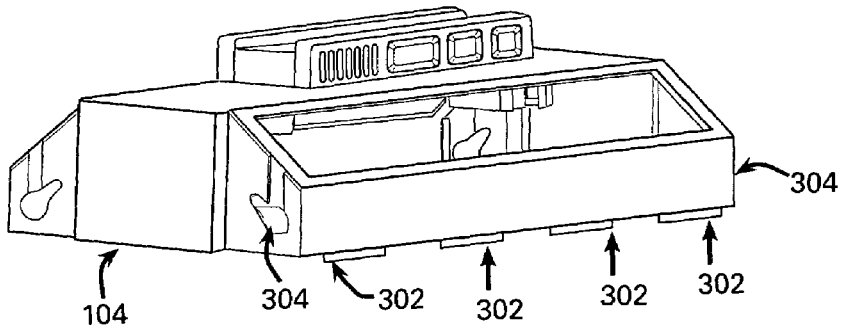
FIG. 3 shows an isolated view of the base.

The game assembly is able to maintain its inclined surface feature through a combination of the locking hinge 112 and an interlocking set of bars. FIG. 2 and FIG. 3 show isolated illustrations of one of the pair of support assemblies 102 and the base 104 respectively.

The locking hinge is created by a set of plastic fasteners 204 located on the side of each of the pair of support assemblies 102 that connects to the base 104 through a set of notches 304. The set of plastic fasteners 204 are "A" shaped with the narrow edge facing the direction of the base 104. The set of plastic fasteners 204 connect to a set of notches 304 on the base 104. The set of notches 304 are shaped similarly to the set of plastic fasteners 204. The narrow half of the set of notches 304 is the exact same size as to match the set of plastic fasteners 204. The wider half of the set of notches 304 is a greater that width of the set of plastic fasteners 204 but it is not larger than the length of the set of plastic fasteners 204. The set of notches 304 is offset by a predetermined angle from the base 102, i.e. the set of notches 304 create an angle x from the bottom of the base 102. The set of notches 304 and the set of plastic fasteners 304 are designed by this method because by making the narrow part of the set of notches 304 the size of the set of plastic fasteners 204, when the pair of support assemblies 102 are oriented so that the set of plastic fasteners 204 slides into the narrow part of the set of notches 304 it would be locked in and unable to move except for one direction. When the pair of support assemblies 102 is positioned with the set of plastic fasteners 204 locked into the set of notches 304, the game assembly may be propped up on the ends of the pair of support assemblies 102. This allows the weight of the game assembly to keep the set of plastic fasteners locked into the narrow part of the set of notches 304 allowing the base 104 and upright assembly 100 to be suspended in the air and the set of support assemblies 102 lying at an incline to the base 104, thus creating the inclined playing surface as shown in FIG. 1.

The interlocking sets of bars help to secure the inclined playing surface created by the locking hinge 112. The interlocking set of bars is made of up two sets of bars, one set of bars 202 positioned on the edge facing the base 104 of the pair of support assemblies 102 and another set of bars 302 positioned on the underside of the edge of the base 104. Each set of bars 202, 302 is made up of separate bars spaced evenly along either the edge of the base 104 or the edge of the pair of the support assemblies. The set of bars 202, 302 interlock when the locking hinge 112 becomes locked, i.e. when the set of plastic fasteners 204 slide into the narrow part of the set of notches 304. When interlocked in this position, the set of bars 202, 302 help to absorb the weight of the base 104 and upright assembly 100 as they are suspended in the air. This ensures that the locking hinge 112 will stay secure in the locked position, i.e. when the set of plastic fasteners 204 slide into the narrow part of the set of notches 304.

Figure 4:
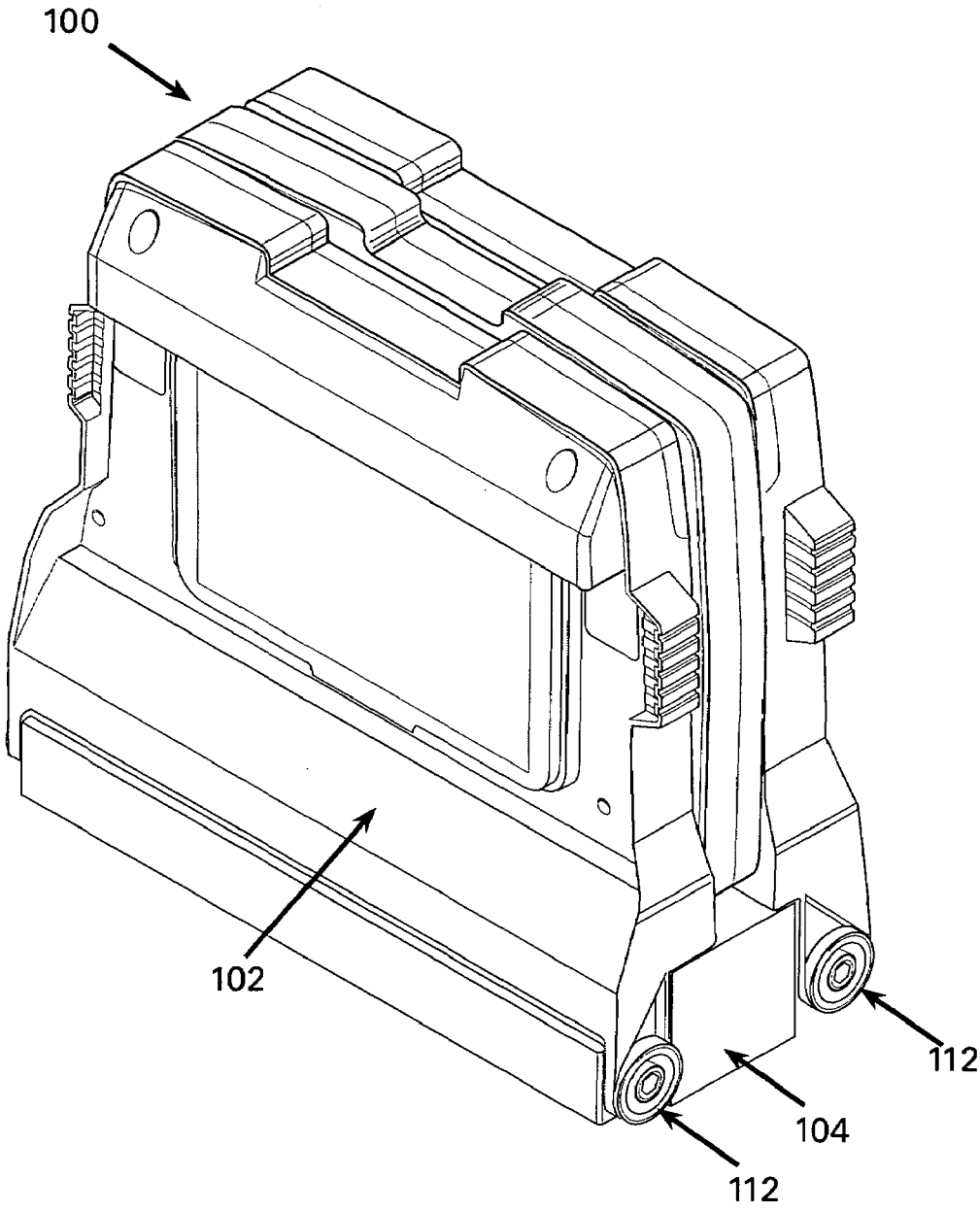
FIG. 4 illustrates a view of a game assembly embodiment where the pair of support assemblies is folded upward to meet the upright assembly.

When the locking hinge 112 is in the unlocked position, i.e. when the set of plastic fasteners 204 are located in the wide part of the set of the notches 304, the pair of support assemblies 102 are able to pivot around the base 104. As illustrated by FIG. 4, this allows for the pair of support assemblies 102 to pivot upward to the point where they meet the upright assembly 1002. The pair of support assemblies may contain a small latch 206 which when the pair of support assemblies are in the upright position, the small latch would secure the pair of support assemblies 102 to the upright assembly 100. This allows for the game assembly to be compacted for easy storage or transport.

It should be appreciated that a wide range of changes and modifications may be made to the embodiments of the inventions as described herein. It is intended that the foregoing detailed description be regarded as illustrative rather than limiting. While there have been illustrated and described particular embodiments of the inventions, it will be appreciated that numerous changes and modifications will occur to those skilled in the art, and it is intended in the appended claims to cover those changes and modifications which fall within the true spirit and scope of the present invention.

What is claimed is:

1. A board game device comprising:

a base comprising a top, a first side and a second side thereof;

a first game surface assembly connecting at the first side of the base;

a second game surface assembly connecting at the second side of the base, said first game surface assembly and said second game surface assembly connecting to the base above a supporting surface, with each of said first game surface assembly and said second game surface assembly at an inclined angle to the supporting surface;

a third game surface assembly connecting at the top of the base, said third game surface assembly comprising a front side and a back side thereof;

a player interface electronic control panel on said base;

a plurality of game pieces comprising a peg which connects with each of said first game surface assembly, said second game surface assembly, and said third game surface assembly; and said third game surface assembly defining a grid of holes on each of said front side and said back side of said third game surface assembly which allow said peg of said plurality of game pieces to easily and securely fit therein, and said first game surface assembly and said second game surface assembly each defining further grids of holes which allow said peg of said plurality of game pieces to easily and securely fit therein.

2. The game device of claim 1, wherein a further plurality of game pieces comprise two or more pegs which connect with said first game surface assembly and said second game surface assembly.

3. The game device of claim 1, comprising a locking hinge which couples with said first game surface assembly to pivot and lock at the first side of said base.

4. The game device of claim 1, comprising a locking hinge which couples with said first and said second game surface assemblies to pivot and lock with said base.

5. The game device of claim 1, wherein said first and said second game surface assemblies comprise a small latch for securing with said third game surface assembly.

6. The game device of claim 1, wherein said first and said second game surface assemblies comprise means for balancing the weight of said base above the supporting surface.

7. The game device of claim 1, comprising a locking hinge which couples with said first and said second game surface assemblies to pivot and lock with said base, with said first and said second game surface assemblies standing on their ends to support and balance the weight of said base and said third assembly.

8. The game device of claim 1, wherein said plurality of game pieces comprise miniature ships and said first and said second game surface assemblies comprise grid coordinates for said ships.

* * * * *